US006401485B1

(12) United States Patent
Hildreth, Jr.

(10) Patent No.: US 6,401,485 B1
(45) Date of Patent: Jun. 11, 2002

(54) DISCHARGE REFRIGERANT HEATER FOR INACTIVE COMPRESSOR LINE

(75) Inventor: Edward D. Hildreth, Jr., Clarksville, TN (US)

(73) Assignee: American Standard Inc., Piscataway, NJ (US)

( * ) Notice: Subject to any disclaimer, the term of this patent is extended or adjusted under 35 U.S.C. 154(b) by 0 days.

(21) Appl. No.: 09/680,765

(22) Filed: Oct. 6, 2000

(51) Int. Cl.[7] ..... F25B 1/10
(52) U.S. Cl. ..... 62/510; 62/113; 62/513
(58) Field of Search ..... 62/113, 513, 510, 62/228.5, 196.2; 236/1 EA

(56) References Cited

U.S. PATENT DOCUMENTS 3,645,109 A * 2/1972 Quick ..... 62/196.2
3,766,745 A * 10/1973 Quick ..... 62/196.2
3,869,874 A * 3/1975 Ditzler ..... 62/510
4,051,691 A * 10/1977 Dawkins ..... 62/510
4,184,341 A * 1/1980 Friedman ..... 236/1 EA
4,332,137 A * 6/1982 Hayes, Jr. ..... 62/510
4,554,795 A 11/1985 Ibrahim
4,589,263 A * 5/1986 DiCarlo et al. ..... 62/510
4,621,505 A * 11/1986 Ares et al. ..... 62/510
4,628,700 A * 12/1986 Alsenz ..... 62/228.5
4,729,228 A * 3/1988 Johnsen ..... 62/510
4,750,337 A * 6/1988 Glamm ..... 62/510
5,094,598 A * 3/1992 Amata et al. ..... 62/510

* cited by examiner

*Primary Examiner*—Teresa Walberg
*Assistant Examiner*—Fadi H. Dahbour
(74) *Attorney, Agent, or Firm*—William J. Beres; William O'Driscoll

(57) ABSTRACT

A refrigerant system includes two compressors that are independently activated to meet a variable cooling demand of a comfort zone or a process. For high cooling demands, both compressors are operated. However, for lower cooling demands, one compressor is de-activated, while the other continues running. To help prevent refrigerant from condensing in the vicinity of the relatively cool inactive compressor, heat from the discharge line of the running compressor heats the suction or discharge line of the inactive compressor. To transfer heat from one line to the other, the two lines are simply held against each other in a parallel, side-by-side relationship.

24 Claims, 1 Drawing Sheet

DISCHARGE REFRIGERANT HEATER FOR INACTIVE COMPRESSOR LINE

BACKGROUND OF THE INVENTION

1. Field of the Invention

The subject invention generally pertains to refrigerant systems with multiple compressors and more specifically to preventing liquid refrigerant from migrating to an inactive compressor.

2. Description of Related Art

When using a refrigerant system for process or for cooling a room or some other comfort zone of a building, often the system includes a single evaporator/condenser circuit with two or more compressors. Usually all of the compressors run when the cooling demand is high; however, as the cooling demand decreases, some of the compressors can be turned off. Unfortunately, running one compressor while leaving another of the same refrigerant circuit inactive can create problems.

In particular, refrigerant tends to condense near the inactive compressor, because the inactive compressor is relatively cool. As the refrigerant condenses in the vicinity of the inactive compressor, more refrigerant migrates to the area. Eventually, the inactive suction or discharge line leading to the compressor and/or the compressor itself can become flooded with liquid refrigerant. Later, when the compressor restarts, the liquid refrigerant may damage the compressor.

For example, starting a compressor with liquid refrigerant in its suction line can create destructively high forces within the compressor as the compressor tries compressing the virtually incompressible liquid. If the discharge line of the compressor is flooded, the compressor's discharge valve may be damaged, as such valves are typically designed for gas flow: not liquid. If the compressor itself becomes flooded, the liquid refrigerant may wash the oil from the compressor's bearings, or create the same problems as those of a flooded suction or discharge line.

One way to prevent refrigerant from condensing within a compressor is to electrically heat the compressor. Such an approach, however, not only consumes electrical energy, but also does little in preventing liquid refrigerant from accumulating in the suction or discharge lines. Moreover, if an electrical heater were to fail due to a relay failure, blown fuse, a break in the electrical line, or some other cause, a flooded compressor might still be started and perhaps damaged.

Consequently, a need exists for a reliable, cost-effective approach for inhibiting liquid refrigerant from flooding an inactive compressor and its adjacent suction or discharge lines.

SUMMARY OF THE INVENTION

To avoid flooding an inactive compressor of a multi-compressor refrigerant system, it is an object of the invention to heat the inactive compressor's suction and/or discharge line using the heat from an active compressor's discharge line.

Another object of the invention, in some embodiments, is to provide heat exchange between two refrigerant lines by using the lines themselves to transfer the heat rather than using a dedicated heat exchanger.

Another object of the invention, in some embodiments, is to place two parallel refrigerant lines against each other to provide a line of contact that promotes heat transfer between the two.

Another object of the invention is to insulate two refrigerant lines that are in intimate contact with each other, so that the insulation helps promote more heat transfer between the two lines.

Yet another object of the invention is to ensure that the suction line of the inactive compressor is always heated by the discharge line of the active compressor so that either compressor can be staged.

These and other objects of the invention are provided by a refrigerant system that includes two compressors, each of which have a suction line and a discharge line. To meet lower cooling demands, one compressor is de-activated, while the other continues running. Heat from the discharge line of the running compressor heats the suction or discharge line of the inactive compressor to help prevent refrigerant from condensing in the vicinity of the inactive compressor.

The present invention provides a refrigerant system. The system includes an active compressor having an active discharge line; and an inactive compressor having an inactive suction line and an inactive discharge line. The active discharge line is disposed in heat transfer relationship with at least one of the inactive suction line and the inactive discharge line to help prevent liquid refrigerant from migrating to the inactive compressor.

The present invention also provides a refrigerant system including an active compressor having an active discharge line; and an inactive compressor having an inactive suction line and an inactive discharge line. The active discharge line is held against at least one of the inactive suction line and the inactive discharge line to promote heat transfer from the active discharge line to at least one of the inactive suction line and the inactive discharge line.

The present invention further provides a refrigerant system for meeting a variable cooling demand. The system includes a first compressor, a second compressor, an evaporator, a condenser, a flow restrictor, and a thermal connection. The first compressor is coupled to a first discharge line and a first suction line and is adapted to compress a refrigerant; and the second compressor has an active mode and an inactive mode to provide the refrigerant system with a variable capacity for meeting the variable cooling demand. The second compressor is coupled to a second discharge line and a second suction line. The evaporator has an evaporator inlet and an evaporator outlet with the evaporator inlet being in fluid communication with the first discharge line and the second discharge line. The condenser has a condenser inlet and a condenser outlet with the condenser outlet being in fluid communication with the first suction line and the second suction line. The flow restriction helps place the evaporator outlet in fluid communication with the condenser inlet. The thermal connection places the first discharge line in heat transfer relationship with at least one of the second discharge line and the second suction line. Heat from the first discharge line transfers to at least one of the second discharge line and the second suction line to help prevent liquid refrigerant from migrating to the second compressor when in the inactive mode.

BRIEF DESCRIPTIONS OF THE DRAWINGS

DESCRIPTION OF THE PREFERRED EMBODIMENT

Figure 1:
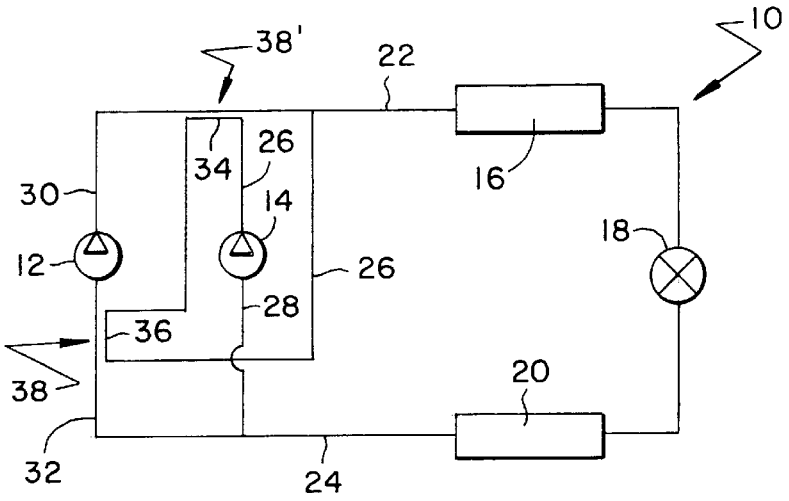
FIG. 1 is a schematic diagram of a refrigerant system according to a first embodiment of the invention.

A refrigerant system 10, shown in FIG. 1, includes two refrigerant compressors 12 and 14; a condenser 16; a flow restriction 18, such as an expansion valve; and an evaporator 20. Compressors 12 and 14 are connected in parallel-flow relationship between a discharge manifold 22 and a suction manifold 24. A discharge line 26 and a suction line 28 connects compressor 14 to discharge manifold 22 and suction manifold 24, respectively. And another discharge line 30 and a suction line 32 connects compressor 12 to discharge manifold 22 and suction manifold 24, respectively.

Compressed refrigerant discharged from compressors 12 and 14 travels in series through discharge manifold 22, condenser 16, restriction 18, evaporator 20, and suction manifold 24. Hot, compressed refrigerant in condenser 16 emits heat, refrigerant leaving condenser 16 vaporizes and thus cools upon passing through restriction 18, and the relatively cool, lower pressure refrigerant in evaporator 20 absorbs heat, often for the purpose of cooling a comfort zone, such as a room or some other area within a building.

When the cooling demand of the comfort zone is high, both compressors 12 and 14 can be run to operate system 10 at its full capacity. However, when the cooling demand is relatively low, one of the compressors can be de-activated (e.g., de-energized or unloaded). For example, compressor 12 can stop running, while compressor 14 continues running to operate system 10 at reduced load.

Figure 2:
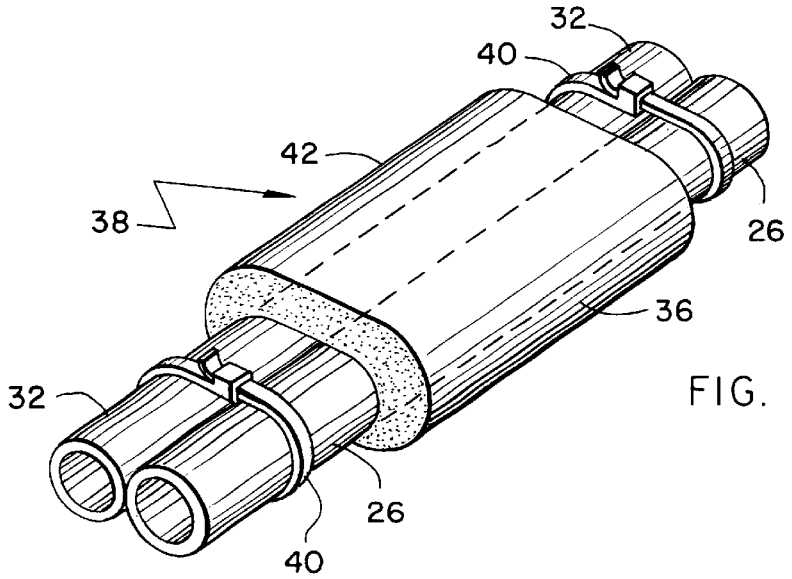
FIG. 2 is a perspective cutaway view of two refrigerant lines of the system shown in FIG. 1.

To help prevent refrigerant from condensing within the inactive suction and discharge lines 32 and 30 or condensing within the inactive compressor 12 itself, the active discharge line 26 of compressor 14 is routed in a unique manner. In particular, a portion 34 of discharge line 26 is held against discharge line 30, and another portion 36 of discharge line 26 is run in a similar manner along suction line 32. Over a predetermined length (e.g., six inches) the outer tube walls of lines 26 and 30, and lines 26 and 32 are held against each other in a parallel, side-by-side relationship to create thermal connections 38 and 38' that allow active discharge line 26 to heat inactive lines 30 and 32, as shown in FIG. 2. The heat from the hot, compressed refrigerant inside active discharge line 26 helps prevent refrigerant from condensing within inactive lines 30 and 32. Although the illustrated connection 38 is for lines 26 and 32, a virtually identical connection 38' can be provided for lines 26 and 30.

Lines 26 and 32 can be held against each other in a variety of ways. For example, a conventional plastic cable tie 40 constricts around both lines 26 and 32. In some forms of the invention, thermal insulation 42 is wrapped around lines 26 and 32 to promote heat transfer between the two rather than allowing the heat to escape to the surrounding air.

Figure 3:
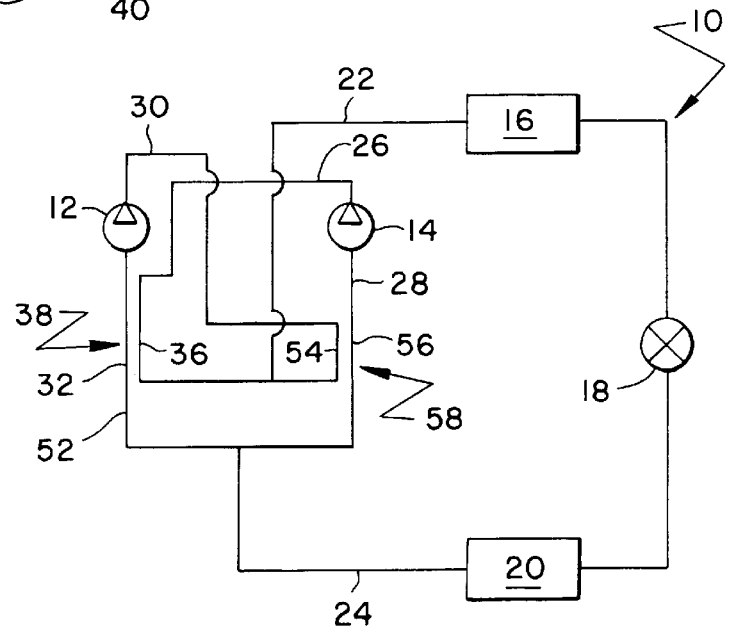
FIG. 3 is a schematic diagram of a refrigeration system according to a second embodiment of the invention.

FIG. 3 shows a second preferred embodiment of the present invention where like numerals are used to represent like elements of the first embodiment. In staging the compressors of a multiple compressor on and off, it is desirable to equalize the run time of each compressor and it is desirable that each of the compressors 12, 14 be able to be placed in an inactive state without accumulating liquid refrigerant.

In the second embodiment of FIG. 3, a portion 36 of the discharge line 26 of the compressor 14 is in heat exchange relationship with a portion 52 of the suction line 32 of the compressor 12. Similarly, a portion 54 of the discharge line 30 of the compressor 12 is in heat exchange relation with a portion 56 of the suction line 28 of the compressor 14. Thus, a thermal connection 38 between portions 36 and 52 is created and a thermal connection 58 between portions 54 and 56 is created. In this arrangement, either compressor 12 or 14 can be inactive or active, and its suction line will be heated by the discharge line of the active compressor.

Although the invention is described with respect to preferred embodiments, various modifications thereto will be apparent to those skilled in the art. For example, although discharge line 26 is shown heating both lines 30 and 32, discharge line 26 could instead be used to heat just one of lines 30 or 32. Also, system 10 is shown having only two compressors 12 and 14; however, the invention applies to any number of compressors connected in parallel-flow relationship to each other. In other words, discharge line 26 could be routed to heat the suction and discharge lines of several inactive compressors of the same refrigerant system. The lines 30, 32 could also be helically entwined to further increase heat transfer.

Therefore, the scope of the invention is to be determined by reference to the claims, which follow.

I claim:

1. A refrigerant system, comprising:

an active compressor having an active discharge line; and an inactive compressor having an inactive suction line and an inactive discharge line, wherein the active discharge line is disposed in heat transfer relationship with at least one of the inactive suction line and the inactive discharge line to help prevent liquid refrigerant from migrating to the inactive compressor.

2. The refrigerant system of claim 1, wherein the active discharge line is disposed in heat transfer relationship with the inactive discharge line.

3. The refrigerant system of claim 1, wherein the active discharge line is disposed in heat transfer relationship with the inactive suction line.

4. The refrigerant system of claim 3 wherein the active compressor includes an active suction line; and where the inactive discharge line is disposed in heat transfer relation with the active suction line.

5. The refrigerant system of claim 1, wherein the active compressor and the inactive compressor are coupled to a common evaporator.

6. The refrigerant system of claim 1, wherein the active compressor and the inactive compressor are coupled to a common condenser.

7. The refrigerant system of claim 1, wherein an outer wall of the active discharge line is held against a second outer wall of at least one of the inactive discharge line and the inactive suction line.

8. The refrigerant system of claim 7, wherein a portion of the active discharge line is substantially parallel to at least one of the inactive discharge line and the inactive suction line.

9. The refrigerant system of claim 8, wherein a portion of the active discharge line is substantially parallel to at least one of the inactive discharge line and the inactive suction line.

10. A refrigerant system, comprising:

an active compressor having an active discharge line; and an inactive compressor having an inactive suction line and an inactive discharge line, wherein the active discharge line is held against at least one of the inactive suction line and the inactive discharge line to promote heat transfer from the active discharge line to at least one of the inactive suction line and the inactive discharge line.

11. The refrigerant system of claim 10, wherein the active discharge line is disposed in heat transfer relationship with the inactive discharge line.

12. The refrigerant system of claim 10, wherein the active discharge line is disposed in heat transfer relationship with the inactive suction line.

13. The refrigerant system of claim 12, the active compressor having an active suction line; and wherein the inactive discharge line is disposed in heat transfer relationship with the active suction line.

14. A refrigerant system for meeting a variable cooling demand, comprising:

a first compressor coupled to a first discharge line and a first suction line and being adapted to compress a refrigerant;

a second compressor having an active mode and an inactive mode to provide the refrigerant system with a variable capacity for meeting the variable cooling demand, the second compressor being coupled to a second discharge line and a second suction line;

an evaporator having an evaporator inlet and an evaporator outlet with the evaporator inlet being in fluid communication with the first discharge line and the second discharge line;

a condenser having a condenser inlet and a condenser outlet with the condenser outlet being in fluid communication with the first suction line and the second suction line;

a flow restriction that helps place the evaporator outlet in fluid communication with the condenser inlet; and a thermal connection that places the first discharge line in heat transfer relationship with at least one of the second discharge line and the second suction line, whereby heat from the first discharge line transfers to at least one of the second discharge line and the second suction line to help prevent liquid refrigerant from migrating to the second compressor when in the inactive mode.

15. The refrigerant system of claim 14, wherein the thermal connection thermally couples the first discharge line to the second discharge line.

16. The refrigerant system of claim 14, wherein the thermal connection thermally couples the first discharge line to the second suction line.

17. The refrigerant system of claim 14, the first compressor having an active mode and an inactive mode; and further including a second thermal connection that places the first section line in heat transfer relation to the second discharge line.

18. The refrigerant system of claim 14, further comprising a discharge manifold that couples the first discharge line and the second discharge line to the condenser inlet.

19. The refrigerant system of claim 14, wherein the refrigerant from the first compressor travels past the thermal connection before entering the discharge manifold.

20. The refrigerant system of claim 14, further comprising a suction manifold that couples the first suction line and the second suction line to the evaporator outlet.

21. The refrigerant system of claim 14, wherein the thermal connection is provide by an outer wall of the first discharge line being held against a second outer wall of at least one of the second discharge line and the second suction line.

22. The refrigerant system of claim 21, further comprising thermal insulation disposed around the thermal connection.

23. The refrigerant system of claim 14, wherein a portion of the first discharge line at the thermal connection is substantially parallel to at least one of the second discharge line and the second suction line.

24. The refrigerant system of claim 14, wherein the first compressor operates more often than the second compressor.

* * * * *

UNITED STATES PATENT AND TRADEMARK OFFICE

CERTIFICATE OF CORRECTION

PATENT NO. : 6,401,485 B1
DATED : June 11, 2002
INVENTOR(S) : Edward D. Hildreth, Jr.

It is certified that error appears in the above-identified patent and that said Letters Patent is hereby corrected as shown below:

Column 6,
Line 7, delete "section" and insert -- suction --.

Signed and Sealed this

Twenty-first Day of January, 2003

JAMES E. ROGAN
*Director of the United States Patent and Trademark Office*